US011286125B2

(12) United States Patent
Izumiya et al.

(10) Patent No.: US 11,286,125 B2
(45) Date of Patent: Mar. 29, 2022

(54) MEASURING DEVICE, IMAGE FORMING APPARATUS, AND MEASURING METHOD

(71) Applicant: KONICA MINOLTA, INC., Tokyo (JP)

(72) Inventors: Yumiko Izumiya, Hachioji (JP); Satoshi Ogata, Hachioji (JP); Kazutoshi Yoshimura, Hino (JP); Hitoshi Asano, Toyokawa (JP); Hirotada Seki, Toyokawa (JP); Akimasa Ishikawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 120 days.

(21) Appl. No.: 16/741,922

(22) Filed: Jan. 14, 2020

(65) Prior Publication Data

US 2020/0255239 A1 Aug. 13, 2020

(30) Foreign Application Priority Data

Feb. 7, 2019 (JP) ..... JP2019-020407

(51) Int. Cl.
*B65H 5/06* (2006.01)
*B65H 7/02* (2006.01)
*B65H 5/16* (2006.01)

(52) U.S. Cl.
CPC ..... *B65H 5/062* (2013.01); *B65H 5/16* (2013.01); *B65H 7/02* (2013.01);
(Continued)

(58) Field of Classification Search
CPC . B65H 5/062; B65H 5/36; B65H 7/00; B65H 7/02; B65H 2301/443;
(Continued)

(56) References Cited

U.S. PATENT DOCUMENTS 7,634,943 B2 * 12/2009 Kawasaki ..... B65H 7/02 73/159
2008/0001348 A1 * 1/2008 Kawasaki ..... B65H 7/02 271/259

(Continued)

FOREIGN PATENT DOCUMENTS

JP H07172631 A 7/1995
JP 2015205775 A 11/2015

*Primary Examiner* — Prasad V Gokhale
(74) *Attorney, Agent, or Firm* — Cantor Colburn LLP

(57) ABSTRACT

A measuring device, includes a physical property value detector and a push contact member that pushes to bring a sheet material in contact with the physical property value detector; and further includes a first processor that stops conveyance of the sheet material, pushes to bring the sheet material in contact with the physical property value detector, and detects a physical property value of the sheet material; a second processor that, after having detected the physical property value, cancels the pushing by the push contact member, separates the sheet material from the physical property value detector, and starts conveyance of the sheet material; and a physical property value specifier that specifies the physical property value on a basis of physical property values of a plurality of positions within a surface of the sheet material detected by executing the first processing and the second processing repeatedly.

8 Claims, 7 Drawing Sheets

(52) U.S. Cl.
CPC .... *B65H 2404/144* (2013.01); *B65H 2404/64* (2013.01); *B65H 2511/13* (2013.01); *B65H 2553/414* (2013.01)

(58) Field of Classification Search
CPC .... B65H 2301/44318; B65H 2404/144; B65H 2404/1441; B65H 2404/64; B65H 2511/13; B65H 2515/112; B65H 2515/12; B65H 2515/81
See application file for complete search history.

(56) References Cited

U.S. PATENT DOCUMENTS

| | | | | |
|---|---|---|---|---|
| 2018/0152126 | A1* | 5/2018 | Nito | B41J 11/007 |
| 2020/0198910 | A1* | 6/2020 | Takato | H04N 1/00604 |

* cited by examiner

MEASURING DEVICE, IMAGE FORMING APPARATUS, AND MEASURING METHOD

CROSS-REFERENCE TO RELATED APPLICATION

The present invention claims priority under 35 U.S.C. § 119 to Japanese patent application No. 2019-020407, filed on Feb. 7, 2019, the entire contents of which are incorporated herein by reference.

BACKGROUND

1. Technological Field

The present invention relates to a measuring device, an image forming apparatus, and a measuring method, and especially relates to a measuring device that detects the physical property value of a sheet material, an image forming apparatus equipped with the measuring device, and a measuring method the detects the physical property value of a sheet material.

2. Description of the Related Arts

A measuring device has been known that provides a detecting section to detect the physical property value of a sheet material on a conveyance route that conveys a recording medium, such as a sheet material, by a plurality of roller pairs (opposing roller) and is equipped with a function that discriminates a type, a basic weight, etc. of the sheet material conveyed by the roller pairs. Into an image forming apparatus, such as MFP (Multi-Functional Peripherals), the above-described measuring device is incorporated, and an image formation condition is set on the basis of the discriminated type, basic weight, etc. of a sheet material, whereby an image according to the sheet material can be formed.

In the conveyance of a sheet material by roller pairs, the sheet material is transferred from a roller pair on the upstream side to a roller pair on the downstream side arranged on a conveyance route, thereby conveying the sheet material. In order to improve the detection accuracy of the physical property value of a sheet material, it is required to make the positional relationship between a detecting section and a sheet material constant and to perform the detection on the same conditions every time.

With regard to an apparatus equipped with such a detecting section, for example, Patent Literature 1 (JP H7-172631A) discloses a document double-feed detecting device that includes a paper leading end detecting section that detects the paper leading end of a document taken out from a sheet feed tray and conveyed on a document conveyance path, and a paper thickness detecting section that detects the thickness of the document conveyed on the document conveyance path via the paper leading end detecting section, wherein whether the double-feed of the documents has occurred during the conveyance of the documents is determined on the basis of information with regard to the leading end of the document detected by the paper leading end detecting section and the paper thickness of the document detected by the paper thickness detecting section. Moreover, in the document double-feed detecting device, there is provided a document holding member that holds a document conveyed on the document conveyance path immediately before the measurement position for the document by the paper thickness detecting section.

Moreover, Patent Literature 2 (JP 2015-205775A) discloses a sheet material discriminating device that includes an information detecting section having an optical information detecting section that makes a light emitting section emit light, irradiates a sheet material with the light, receives the irradiated light by a light receiving section, and detects information on the sheet material, and a discriminating section that discriminates the sheet material on the basis of information on the sheet material detected by the information detecting section. The sheet material discriminating device further includes a displacement member that displaces by sandwiching a sheet material moving in the device between itself and an opposing member from an initial position positioned when the sheet material is not sandwiched between itself and the opposing member and a displace amount detecting section that detects the displace amount of the displacement member, wherein the information detecting section including a sheet material thickness detecting section that detects the thickness of the sheet material on the basis of the detection results of the displace amount detecting section.

SUMMARY

In the case of conveying a sheet material while pushing so as to bring the sheet material in contact with a detecting section on a conveyance route that conveys the sheet material by roller pairs, especially thin sheet material has weak elasticity and cannot maintain the posture of a sheet material sent out from a roller pair (the leading end portion of a sheet material hangs down under its own weight). Accordingly, if there is an obstacle on a conveyance route, there have been problems that a sheet material hits the obstacle and is torn, or conveyance jams, such as paper jam, occurs, and productivity falls.

The present invention has been achieved in view of the above-described problems, and its main object is to provide a measuring device, image forming apparatus, and measuring method that can suppress damage to a sheet material and occurrence of conveyance jam in the case of detecting the physical property value of a sheet material on a conveyance route that conveys a sheet material by a plurality of roller pairs.

In order to realize the above-mentioned object, a measuring device that reflects one aspect of the present invention includes, on a conveyance route to convey a sheet material by a plurality of roller pairs, a physical property value detector that detects a physical property value of the sheet material; and a push contact member that is configured to be movable in a direction orthogonal to a surface of the sheet material and performs a pushing contact operation to push the sheet material so as to bring the sheet material in contact with the physical property value detector; and further includes a first processor to control first processing that stops conveyance of the sheet material, pushes the sheet material so as to bring the sheet material in contact with the physical property value detector by using the push contact member, and detects a physical property value of the sheet material; a second processor to control second processing that, after having detected the physical property value of the sheet material, cancels the pushing contact operation by the push contact member, separates the sheet material from the physical property value detector, and starts conveyance of the sheet material; and a physical property value specifier that specifies the physical property value of the sheet material on a basis of physical property values of a plurality of positions within a surface of the sheet material detected by executing the first processing and the second processing repeatedly.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

As described in BACKGROUND, a measuring device has been known that detects the physical property value of a sheet material by a detecting section provided on a conveyance route that conveys the sheet material by a plurality of roller pairs and is equipped with a function that discriminates a type, a basic weight, etc. of the sheet material. Into image forming apparatuses, this measuring device is incorporated, and an image formation condition is set on the basis of the discriminated type, basic weight, etc. of the sheet material, whereby an image according to the sheet material can be formed. Here, in order to improve the detection accuracy of the physical property value of a sheet material, it is required to make the positional relationship between a detecting section and a sheet material constant and to perform the detection on the same conditions every time.

As a method for that, for example, like Patent Literature 1, a method is considered that disposes a regulating member on a conveyance route and detects by regulating the leading end of a sheet material. However, in this method, the sheet material flutters in a range from the regulating member to the detection position. Accordingly, since the interval between the detecting section and a sheet material changes, a detection accuracy falls.

Figure 9A:
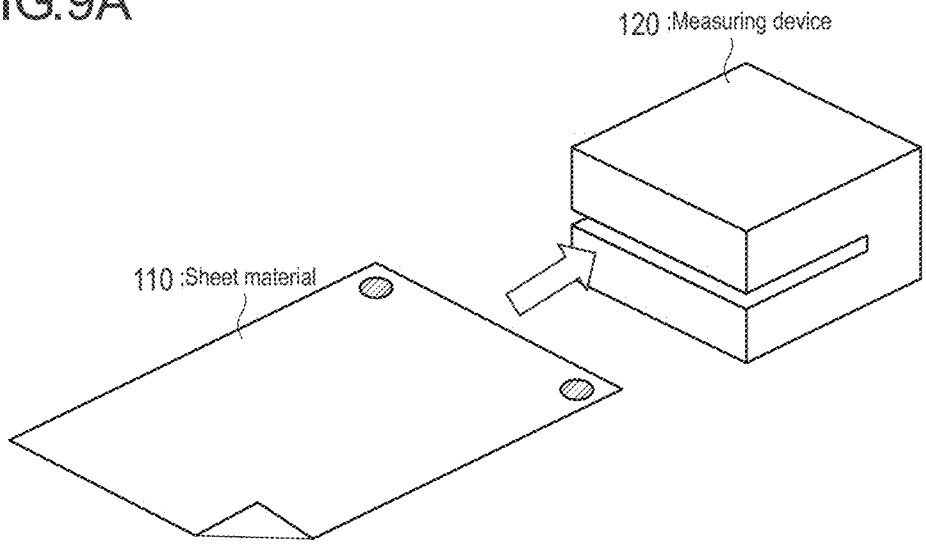
FIG. 9A is a perspective view and a side sectional view showing one example of a structure of a conventional measuring device.
Figure 9B:
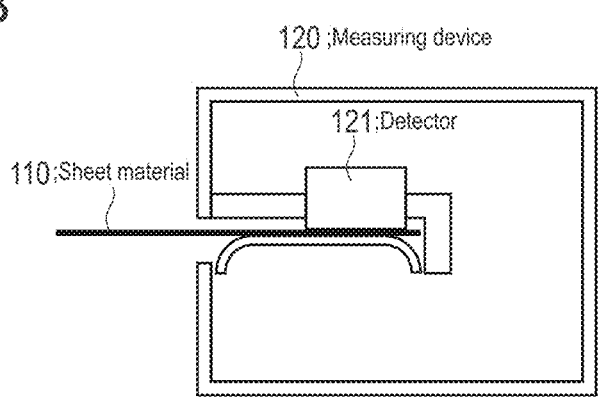
FIG. 9B is a perspective view and a side sectional view showing one example of a structure of a conventional measuring device.

On the other hand, like Patent Literature 2, in the case of a measuring device in which a sheet material is inserted manually, as shown in FIG. 9A and FIG. 9B, a worker can pinch the leading end portion (portion hatched with diagonal lines in FIG. 9A) of a sheet material 110 and can insert it in the measuring device 120. For this reason, the interval between the detector 121 and the sheet material 110 can be kept constant, and it is possible to suppress the fall of detection accuracy. Moreover, in the case of this method, even if the sheet material 110 is inserted while being pushed to be brought in contact with the detector 121, it is not likely to cause problems that the sheet material 110 is torn.

Figure 10:
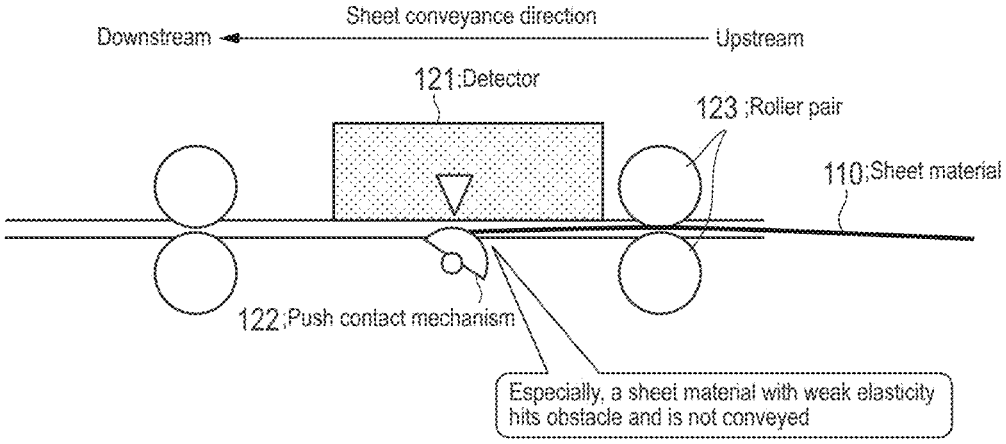
FIG. 10 is a schematic illustration for describing the problems in the conventional measuring device.

However, as shown in FIG. 10, in the case of conveying a sheet material 110 by a plurality of roller pairs 123, especially a thin sheet material 110 has weak elasticity and cannot maintain the posture of a sheet material 110 sent out from a roller pair 123 (the leading end portion of a sheet material 110 hangs down under its own weight). Accordingly, if there is an obstacle, on a conveyance route, such as a push contact mechanism 122 to push so as to bring a sheet material 110 in contact with a detector 121, there have been problems that the leading end of a sheet material 110 with weak elasticity hits the obstacle and is torn, or conveyance jams, such as paper jam, occurs, and productivity falls.

Then, in one embodiment of the present invention, in a measuring device that includes, on a conveyance route that conveys a sheet material by a plurality of roller pairs, a physical property value detector to detect the physical property value of a sheet material and a push contact member that is configured to be movable in a direction orthogonal to the surface of the sheet material and pushes so as to bring the sheet material in contact with the physical property value detector; first processing that stops the conveyance of the sheet material, pushes the sheet material so as to bring the sheet material in contact with the physical property value detector by using the push contact member, and detects a physical property value of the sheet material, second processing that, after having detected the physical property value of the sheet material, cancels the pushing contact operation by the push contact member, separates the sheet material from the physical property value detector, and starts the conveyance of the sheet material, and physical property value specifying processing that specifies the physical property value of the sheet material on the basis of physical property values of a plurality of positions within the surface of the sheet material detected by executing the first processing and the second processing repeatedly, are executed.

In concrete terms, in the measuring device that includes a push contact member to push so as to bring a sheet material in contact with a detector, when the sheet material being conveyed arrives at the detector, the conveyance of the sheet material is stopped once, the sheet material is pushed so as to be brought in contact with the detector by using the push contact member (in the case of including an opposing plate opposite to the push contact member, the sheet material is sandwiched between the push contact member and the opposing plate, and the opposing plate is pushed so as to be brought in contact with the detector), and then, a physical property value is detected. Successively, after having detected the physical property value, the pushing contact operation by the push contact member is cancelled, the sheet material is separated from the physical property value detector (or the opposing plate), then, after conveying the sheet material by only a predetermined distance, again the conveyance of the sheet material is stopped, and a physical property value is detected. This processing is executed by a plurality of times, whereby physical property values at a plurality of positions within the surface of the sheet material are detected, and the physical property value of the sheet material is specified on the basis of the plurality of physical property values.

Here, when pushing so as to bring a sheet material in contact with the detector by using the push contact member, in the both of the upstream side and downstream side of the detector, if the sheet material is held by roller pairs and the both ends of the sheet material are restrained, at the time of pushing, damage will occur, such as the sheet material is torn, or the pushing trace is attached to the sheet material. Then, in a state where any one of the upstream side and downstream side of the sheet material relative to the detector is not held by a roller pair, the sheet material is pushed so as to be brought in contact with the detector.

For that reasons, for example, in the case where one of the upstream side roller pair and downstream side roller pair is depressible (the interval between rollers is adjustable), at the time of detecting the physical property value, roller pairs of the one are separated, whereby any one of the upstream side and downstream side of the sheet material relative to the detector is made a state of not being held by the roller pair (only one side is held). Alternatively, at the time of disposing the sheet material leading end detector to detect the leading end of the sheet material, the disposition of the sheet material leading end detector or the detection interval of the physical property value is adjusted such that the physical property value can be detected in a state where the leading end of the sheet material does not arrive at the roller pair or the back end has been separated from the roller pair.

In this way, in the present embodiment, in a measuring device that includes, on a conveyance route that conveys a sheet material by a plurality of roller pairs, a physical property value detector to detect physical property value of a sheet material and a push contact member that is configured to be movable in a direction orthogonal to the surface of the sheet material and performs a pushing contact operation to push so as to bring the sheet material in contact with the physical property value detector, first processing that stops the conveyance of the sheet material, pushes so as to bring the sheet material in contact with the physical property value detector by using the push contact member, and detects a physical property value of the sheet material, second processing that, after having detected the physical property value of the sheet material, cancels the pushing contact operation by the push contact member, separates the sheet material from the physical property value detector, and starts the conveyance of the sheet material, and physical property value specifying processing that specifies the physical property value of the sheet material on the basis of physical property values of a plurality of positions within the surface of the sheet material detected by executing the first processing and the second processing repeatedly, are executed. By performing such processing, in the case of detecting the physical property value of the sheet material on a conveyance route that conveys the sheet material by a plurality of roller pairs, it is possible to suppress damage to a sheet material and occurrence of conveyance jam at the time of detecting a physical property value.

EXAMPLES

Figure 1:
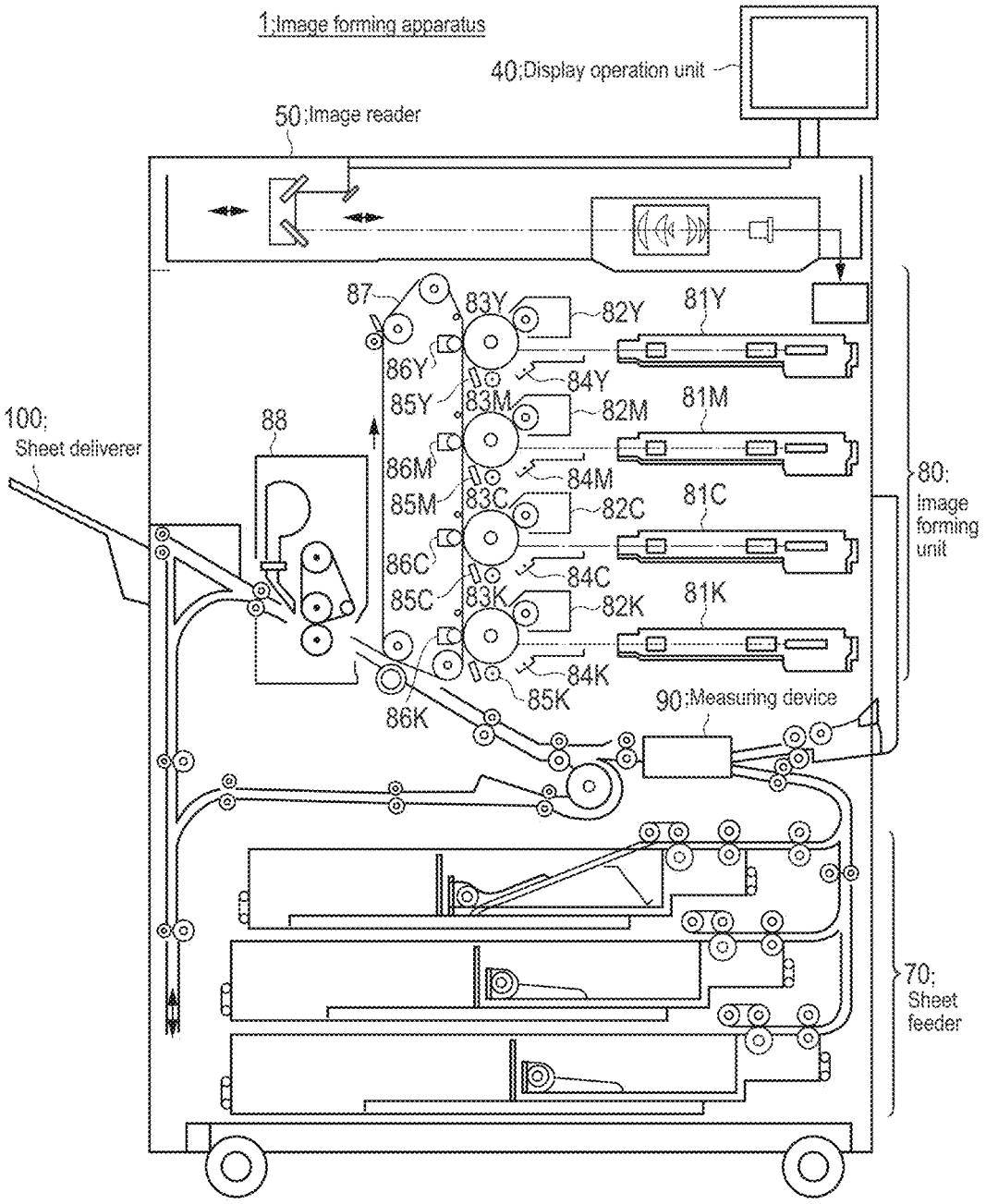
FIG. 1 is a schematic drawing showing a configuration of an image forming apparatus including a measuring device according to one example of the present invention.
Figure 2A:
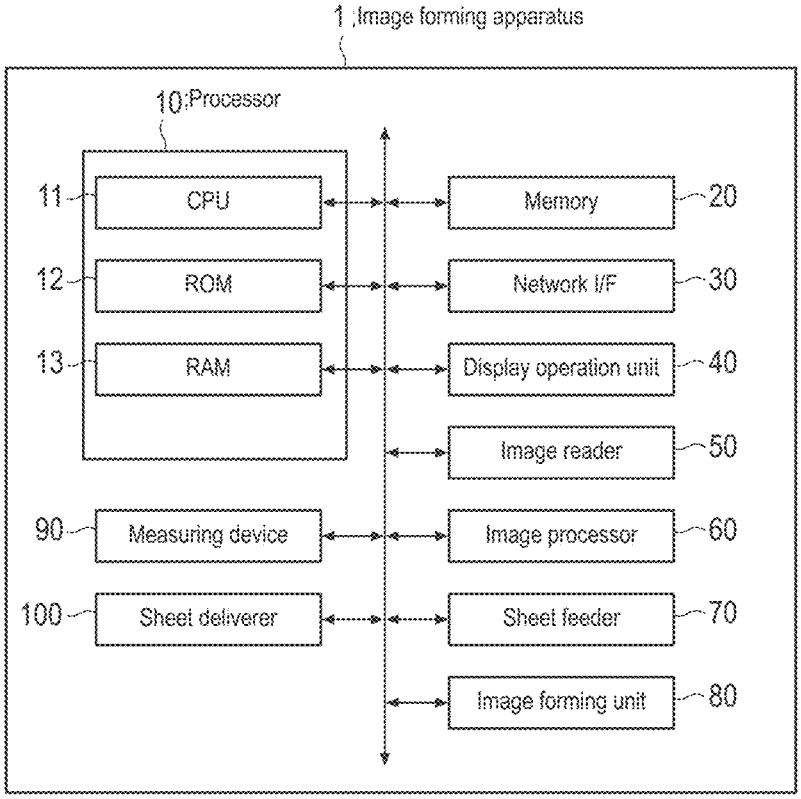
FIG. 2A is a block diagram showing a configuration of the image forming apparatus including a measuring device according to one example of the present invention.
Figure 2B:
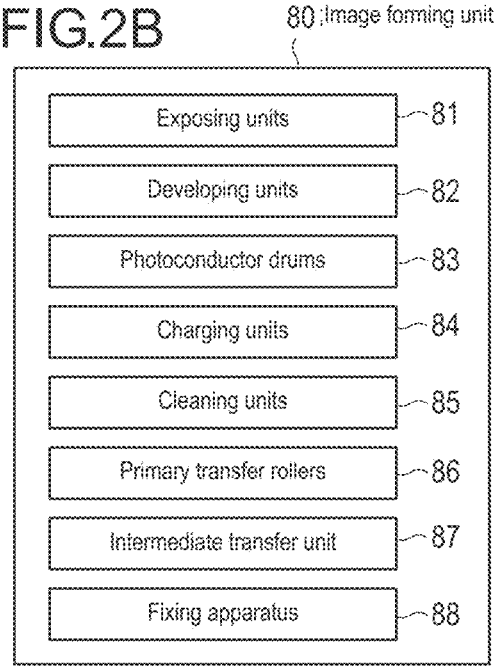
FIG. 2B is a block diagram showing a configuration of an image forming unit of the image forming apparatus.
Figure 2C:
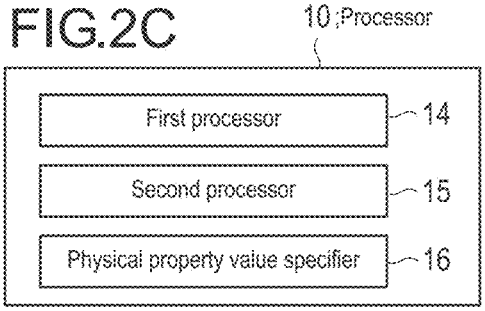
FIG. 2C is a block diagram showing a configuration of a processor of the image forming apparatus.

In order to further describe in detail about the above-described one embodiment of the present invention, a measuring device, an image forming apparatus, and a measuring method according to one example of the present invention will be described with reference to FIG. 1 to FIG. 8. FIG. 1 is a schematic drawing showing a configuration of an image forming apparatus including a measuring device of the present example, and FIG. 2A to FIG. 2C are block diagrams showing a configuration of the image forming apparatus including the measuring device of the present example. Moreover, FIG. 3A, FIG. 3B, FIG. 4A, and FIG. 4B are schematic illustrations showing structures of the measuring device of the present example, and FIG. 5 to FIG. 7B are schematic illustrations showing the operation of the measuring device of the present example. Moreover, FIG. 8 is a flowchart showing the operation of the measuring device.

The measuring device of the present example is a device which detects a physical property value for discriminating the type, the basic weight, etc. of a sheet material that performs image formation. Since the detected physical property value is reflected on process conditions, fixing conditions, the amount of a loop of a registrator to align an image and a sheet, and the like (these are collectively referred to as image forming conditions) at the time of performing image formation, it is preferable that the above-described measuring device is incorporated in the image forming apparatus (especially, to be disposed on a conveyance route of a sheet material from a sheet feeder to the image forming unit 80 (registrator)). In this connection, although, the present example, a configuration in which the measuring device is incorporated in the image forming apparatus, is described, the measuring device may be configured as a single body. Hereinafter, the description will be given on the assumption of the configuration shown in FIG. 1.

As shown in FIG. 1 and FIG. 2A, the image forming apparatus 1 of the present example includes a processor 10, a memory 20, a network OF 30, a display operation unit 40, an image reader 50, an image processor 60, a sheet feeder 70, an image forming unit 80, a measuring device 90, a sheet deliverer 100 and the like.

The processor 10 includes a CPU (Central Processing Unit) 11 and memories such as a ROM (Read Only Memory) 12, a RAM (Random Access Memory) 13, and so on. The CPU 11 reads out a program according to processing contents from the ROM 12 or the memory 20, develops the program into the RAM 13, and executes the program, thereby centrally controlling the operation of each block of the image forming apparatus 1.

The memory 20 includes an HDD (Hard Disk Drive), an SSD (Solid State Drive), and the like and memorizes a program for the CPU 11 to control each part, information with regard to the processing capability of a self-apparatus, image data read by the image reader 50, the image data input from a not-shown client device, and the physical property value of a sheet material specified by a later-mentioned physical property value specifier.

The network I/F 30 includes a NIC (Network Interface Card), a modem, and the like, connects the image forming apparatus 1 to communication networks, such as LAN (Local Area Network) and WAN (Wide Area Network), and performs transmission and reception of various kinds of data with external information devices (for example, client device).

The display operation unit 40 includes a touch panel in which an operation unit (touch sensor) such as a pressure sensitive type or capacitance type with transparent electrodes arranged in the shape of a lattice on a display such as LCD (Liquid Crystal Display) and an organic EL (Electro Luminescence) display, and functions as a display and an operation unit. The display displays various operation screens in accordance with a display control signal input from the processor 10. The operation unit receives various kinds of input operations by a user and outputs an operation signal to the processor 10.

The image reader 50 scans optically a document placed on a contact glass, makes reflected light from a document form an image on a light receiving surface of a CCD (Charge Coupled Device) sensor, thereby reading a document image. An image (analog image signal) read by the image reader 50 is applied with predetermined image processing in the image processor 60.

The image processor 60 includes s circuit that performs an analog digital (A/D) conversion process and a circuit that performs digital image processing. The image processor 60 generates digital image data by performing A/D conversion processing to the analog image signal from the image reader 50. Moreover, the image processor 60 analyzes a print job acquired from external information devices (for example, client device), rasterizes each page of a document, and generates digital image data. Successively, the image processor 60 applies, as required, image processing, such as color conversion processing, correction processing (shading correction etc.) according to initial setting, or user setting, compression processing, and the like, and outputs the image data after the image processing to the image forming unit 80.

The sheet feeder 70 includes a plurality of sheet feed trays that store various sheet materials (paper), and a plurality of roller pairs to convey a sheet material. Sheets stored in the sheet feed tray is sent out one sheet by one sheet from the topmost part and is conveyed by the plurality of roller pairs to the image forming unit 80.

The image forming unit 80 includes, as shown in FIG. 1 and FIG. 2B, exposing units 81 (81Y, 81M, 81C, 81K), developing units 82 (82Y, 82M, 82C, 82K), photoconductor drums 83 (83Y, 83M, 83C, 83K), charging units 84 (84Y, 84M, 84C, 84K), cleaning units 85 (85Y, 85M, 85C, 85K), and primary transfer rollers 86 (86Y, 86M, 86C, 86K), each of which is provided correspondingly to different color components Y, M, C, K, and further includes an intermediate transfer unit 87, a fixing apparatus 88, and a plurality of conveyance rollers to convey a sheet. In this connection, in the following description, a reference number from which Y, M, C, and K are eliminated, is used if needed.

The photoconductor drum 83 of each color component of Y, M, C, K is an image carrier in which an organic photoreceptor layer (OPC) is formed in such a way that an overcoat layer as a protection layer is provided on an outer peripheral surface of a cylindrical metal base made of aluminum material. The photoconductor drum 83 is rotated in the counterclockwise direction in FIG. 1 by following a later-mentioned intermediate transfer belt in a state of being grounded.

The charging unit 84 of each color component Y, M, C, K is a scorotron type, is disposed in the vicinity of a corresponding the photoconductor drum 83 in a state where its longitudinal direction is arranged to be along the rotation axis of the photoconductor drum 83, and then provides the surface of the photoconductor drum 83 with a uniform potential by corona discharge of a polarity same with toner.

The exposing unit 81 of each color component Y, M, C, K, performs scan in parallel to the axis of rotation of the photoconductor drum 83 by, for example, a polygon mirror or the like and performs image exposure on the basis of image data on the uniformly charged surface of a corresponding photoconductor drum 83, thereby forming an electrostatic latent image.

The developing unit 82 of each color component Y, M, C, K stores two-component developer that includes small diameter toner of a corresponding color component and magnetic material conveys the toner onto the surface of the photoconductor drum 83, and visualizes the electrostatic latent image carried by the photoconductor drum 83 with the toner.

The primary transfer roller 86 of each color component Y, M, C, K, brings the intermediate transfer belt in pressure contact with the photoconductor drum 83 so as to primarily transfer respective color toner images formed on the corresponding photoconductor drum 83 sequentially to be superimposed on the intermediate transfer belt.

The cleaning unit 85 of each color component Y, M, C, K, collects remaining toner that remained on the corresponding photoconductor drum 83 after the primary transfer. Moreover, on the downstream side of the cleaning device 85 in the rotation direction of the photoconductor drum 83, there is provided a not-shown coating mechanism of lubricant in an adjacent state that performs the coating of lubricant onto the light sensitive surface of the corresponding photoconductor drum 83.

The intermediate transfer unit 87 includes an endless intermediate transfer belt becoming a transfer receiving target, support rollers, a secondary transfer roller, an intermediate transfer cleaning unit, and the like and is configured such that the intermediate transfer belt is stretched around a plurality of the support rollers. The intermediate transfer belt onto which respective color toner images have been primarily transferred by the primary transfer rollers 86Y, 86M, 86C, and 86K, is brought in pressure contact with a sheet material by the secondary transfer roller, whereby toner images are secondary transferred onto the sheet material and sent to the fixing apparatus 88. The intermediate transfer cleaning unit includes a belt cleaning blade that is brought in slide contact with the surface of the intermediate transfer belt. Transfer residual toner remaining on the surface of the intermediate transfer belt after the secondary transfer is scratched, taken, and removed by the belt cleaning blade.

The fixing apparatus 88 includes a heating roller used as a heat source, a fixing roller, a fixing belt stretched over these rollers, a pressing roller, and the like. The pressing roller is brought in pressure contact with the fixing roller via the fixing belt, and the pressure contact part constitutes a nip portion. Then, the fixing belt heated by the heating roller and each roller perform heating and pressurizing for a sheet material passing the nip portion, whereby unfixed toner image formed on the sheet material is fixed.

The measuring device 90 is disposed on the conveyance route from the sheet feeder 70 to the image forming unit 80 (especially registrator) and includes a physical property value detector that detects physical property values, such as the basic weight (or weight) of a sheet material, moisture content (or water content), a degree of rigidity (or rigidity), surface smoothness, glossiness, density, and a degree of whiteness, a push contact member (opposing plate according the necessity) that is configured to be movable in the direction orthogonal to the surface of a sheet material and performs a pushing contact operation to push so as to bring a sheet material in contact with the physical property value detector, and a sheet material leading end detector that detects the leading end of a sheet material on the conveyance route. For example, in the case of detecting a basic weight optically, a sheet (a sheet material) is irradiated with light from its front surface side and back surface side, light reflected on the sheet and light having transmitted the sheet are detected, and then, the reflected light, diffusion light, and the transmitted light are processed, whereby a basic weight can be detected. Moreover, by measuring the intensity distribution and wavelength of light reflected on the surface of the sheet, surface smoothness, glossiness, degree of whiteness, etc. can be detected. Moreover, by measuring the electric capacitance of a sheet with electrode arranged to the back and front of a sheet, the moisture content of the sheet can be detected. Moreover, by bending a sheet conveyance route, installing a piezoelectric sensor in the portion applied with the above bending, and measuring pressure, the degree of rigidity of a sheet can be detected. Moreover, by installing an encoder in a conveyance roller and measuring displacement, the thickness of a sheet can be detected, and the density of a sheet can also be detected from the basic weight and thickness of a sheet. A detailed structure of this measuring device 90 is mentioned later.

The sheet deliverer 100 includes a plurality of sheet delivery trays and a plurality of roller pairs to convey a sheet material, and a sheet material on which an image has been formed by the image forming unit 80 is delivered to a sheet delivery tray by the plurality of roller pairs.

Moreover, the above-described processor 10, as shown in FIG. 2C, functions as a first processor 14, a second processor 15, a physical property value specifier 16, and the like.

The first processor 14 controls a motor etc. to drive roller pairs, stops the conveyance of a sheet material, and controls first processing that pushes so as to bring a sheet material in contact with the physical property value detector by using a later-mentioned push contact member and detects the physical property value of a sheet material. Moreover, in the case where there is provided an opposing plate that opposes the push contact member via a sheet material, the first processor 14 controls to detect the physical property value of a sheet material in a state where the sheet material is sandwiched between the push contact member and the opposing plate, and the opposing plate is pushed so as to be brought in contact with the physical property value detector. Moreover, when detecting the physical property value of a sheet material, the first processor 14 makes a sheet material into a state of being held by one of the first roller pair located on the upstream side and the second roller pair located on the downstream side on a conveyance route relative to the physical property value detector. For example, in the case where one of the first roller pair or the second roller pair is configured such that the interval between rollers can be adjusted, the interval between rollers of one roller pair is increased and the other roller pair is made in a state of holding a sheet material. Moreover, in the case where there is provided a sheet material leading end detector, when the sheet material leading end detector has detected the leading end of a sheet material, the first processor 14 will be made to perform the first physical property value detection.

After having detected the physical property value of a sheet material, the second processor 15 controls the second processing that cancels the pushing contact operation by the push contact member, makes the sheet material separate from the physical property value detector, and starts the conveyance of the sheet material.

The physical property value specifier 16 specifies the physical property value of a sheet material on the basis on physical property values at a plurality of positions within a surface of a sheet material that have been detected by executing the above-described first processing and second processing repeatedly. At that time, the physical property value specifier 16 adds the count value of a counter for each time when executing both the first processing and the second processing. When the count value exceeds a designated number of times, the physical property value specifier 16 ends the detection of a physical property value and specifies the physical property value of the sheet material.

The above-described first processor 14, second processor 15, and physical property value specifier 16 may be constituted as hardware. Alternatively, the processor 10 may be configured as software (measurement control program) to function as the first processor 14, the second processor 15, and the physical property value specifier 16, and the CPU 11 may be configured to execute the measurement control program.

In this connection, FIG. 1, FIG. 2A, and FIG. 2B show one example of the image forming apparatus 1 according to the present example, and its configuration and control can be changed suitably. For example, in FIG. 1, the measuring device 90 is provided in the inside of the image forming apparatus 1. However, in the case where the sheet feeder 70 is configured as a sheet feed unit separated from the image forming apparatus 1, the measuring device 90 may be disposed between the sheet feed unit and the image forming apparatus 1. Moreover, in the case where it is not necessary to reflect in real time the physical property value detected with the measuring device 90 to image formation, the measuring device 90 may be made to operate alone.

Figure 3A:
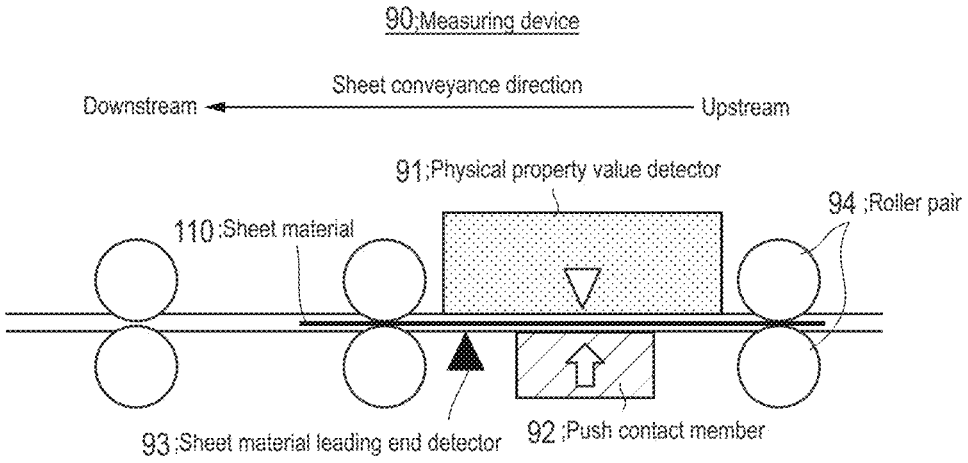
FIG. 3A is a schematic illustration showing a configuration of a measuring device according to one example of the present invention.

Next, the measuring device 90 is described. The measuring device 90 includes, as shown in FIG. 3A, the physical property value detector 91 disposed on the conveyance route that conveys a sheet material 110 by a plurality of roller pairs 94, the push contact member 92 that pushes so as to bring a sheet material in contact with the physical property value detector 91, the sheet material leading end detector 93 that is disposed on downstream side than the physical property value detector 91 and detects the leading end of the sheet material 110 being conveyed, and so on.

The physical property value detector 91, as mentioned above, (1) measures the reflected light, diffusion light, and the transmitted light of light irradiated from the front surface and the back surface of a sheet, (2) measures the intensity distribution and the wavelength of the reflected light, (3) measures the electric capacitance of a sheet with electrode arranged to the back and front of a sheet, (4) measures pressure with the piezoelectric sensor disposed on a bent conveyance route, and (5) measures displacement with the encoder disposed on the roller. By the measurement of any one of these (1) to (5), or a combination of these, the basic weight (or weight) of a sheet material, moisture content (or water content), a degree of rigidity (or rigidity), surface smoothness, glossiness, density, a degree of whiteness, and like are measured.

Figure 3B:
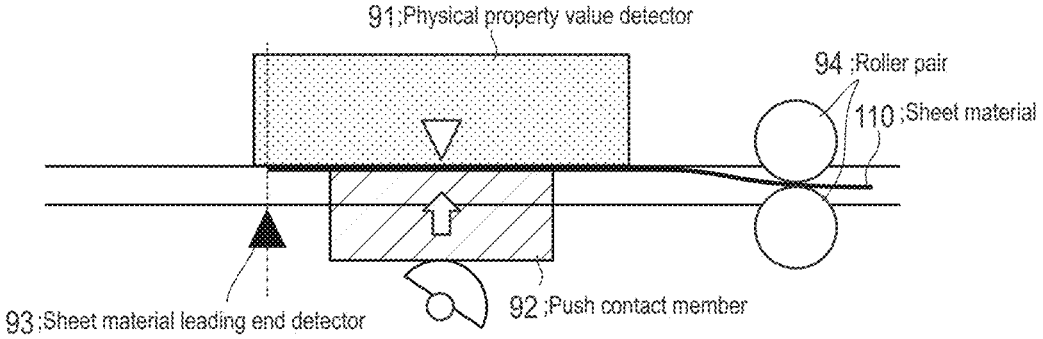
FIG. 3B is a schematic illustration showing a configuration of a measuring device according to one example of the present invention.

Moreover, the push contact member 92 is configured to be movable in the direction orthogonal to the surface of a sheet material. For example, as shown in FIG. 3B, by rotating a cam etc. by a motor, the push contact member 92 is made to move in the direction toward the physical property value detector 91 to push so as to bring the sheet material 110 in contact with the physical property value detector 91, or to cancel the pushing for bringing in contact. In this connection, the shape, structure, size, material, and the like of the push contact member 92 are not limited particularly, and it is enough for the push contact member 92 to be able to push to bring a sheet material 110 certainly in contact with the physical property value detector 91.

Moreover, the sheet material leading end detector 93 detects whether the leading end of the sheet material 110 arrived at a predetermined position. For example, the sheet material leading end detector 93 includes a light source and an optical sensor that are provided at an upper side and a lower side of the conveyance route of the sheet material 110. When the sheet material 110 blocks the light to be entered an optical sensor from a light source, the output of an optical sensor becomes OFF. Accordingly, by detecting that the output of an optical sensor becomes OFF, it is possible to determine whether the leading end of the sheet material has arrived at a predetermined position.

Figure 4A:
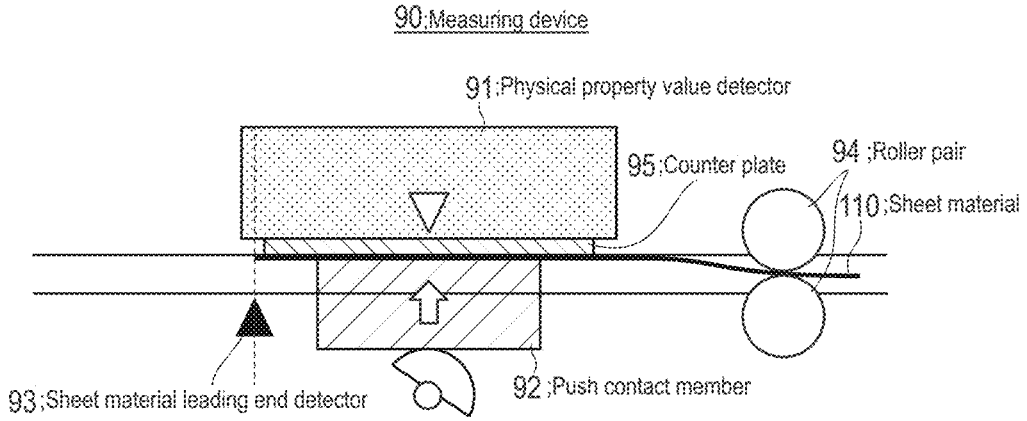
FIG. 4A is a schematic illustration showing another configuration of a measuring device according to one example of the present invention.
Figure 4B:
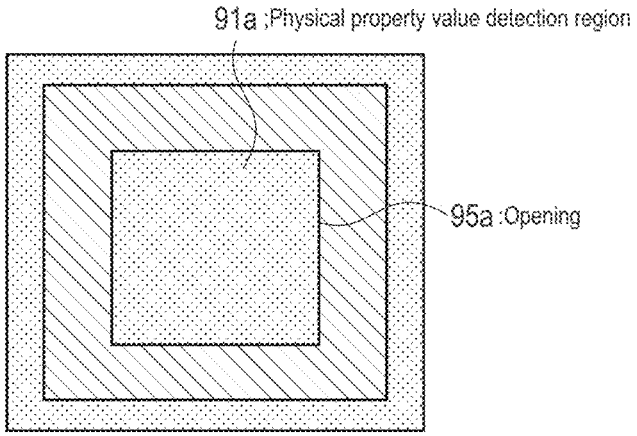
FIG. 4B is a schematic illustration showing another configuration of a measuring device according to one example of the present invention.

In this connection, in FIG. 3A and FIG. 3B, the sheet material 110 is configured to be sandwiched between the push contact member 92 and the physical property value detector 91. However, for example, as shown in FIG. 4A, there is provided an opposing plate 95 at a position corresponding to the push contact member 92 via the sheet material 110, and the sheet material 110 may be configured to be sandwiched between the push contact member 92 and the opposing plate 95. In this case, as shown in FIG. 4B, an opening 95*a* is formed in the opposing plate 95 at a position corresponding to a physical property value detection region 91*a* (for example, a route of light that is reflected on a front surface or transmits from the back surface) of the physical property value detector 91.

Then, at the time of detecting the physical property value of the sheet material 110 using the above-described measuring device 90, when the sheet material leading end detector 93 changes from un-detection to detection, the conveyance of the sheet material 110 is stopped once. Then, in the stopped state, the sheet material 110 is sandwiched between the push contact member 92 and the physical property value detector 91 (in the case of the configuration shown in FIG. 4A and FIG. 4B, between the push contact member 92 and the opposing plate 95). Successively, the sheet material 110 is pushed so as to come in contact with the physical property value detector 91, and then, the first detection of the physical property value is performed. After the detection has been ended, the pushing for bringing in contact by the push contact member 92 is canceled, and the sheet material 110 is made to separate from the physical property value detector 91. Thereafter, the sheet material 110 is conveyed by only a distance designated beforehand, and again the conveyance of the sheet material 110 is stopped once. Then, in the stopped state, the sheet material 110 is sandwiched between the push contact member 92 and the physical property value detector 91 (or between the push contact member 92 and the opposing plate 95). Successively, the sheet material 110 is pushed so as to come in contact with the physical property value detector 91, and then, the second detection of the physical property value is performed. Then, by executing this detection of the physical property value by a plurality of times within the surface of the sheet material 110, the physical property value of the sheet material 110 is specified.

Figure 5:
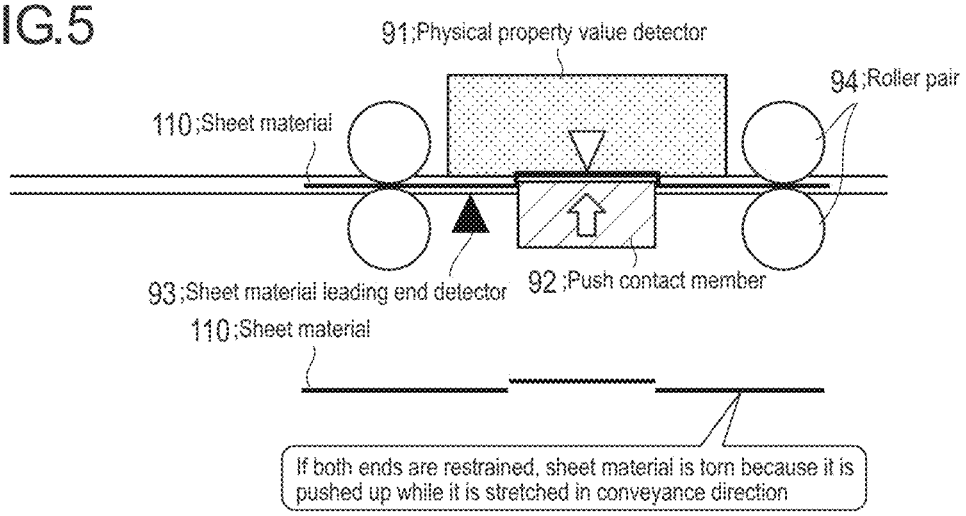
FIG. 5 is a schematic illustration showing operation of a measuring device according to one example of the present invention and showing a case where both ends of a sheet are restrained.
Figure 6:
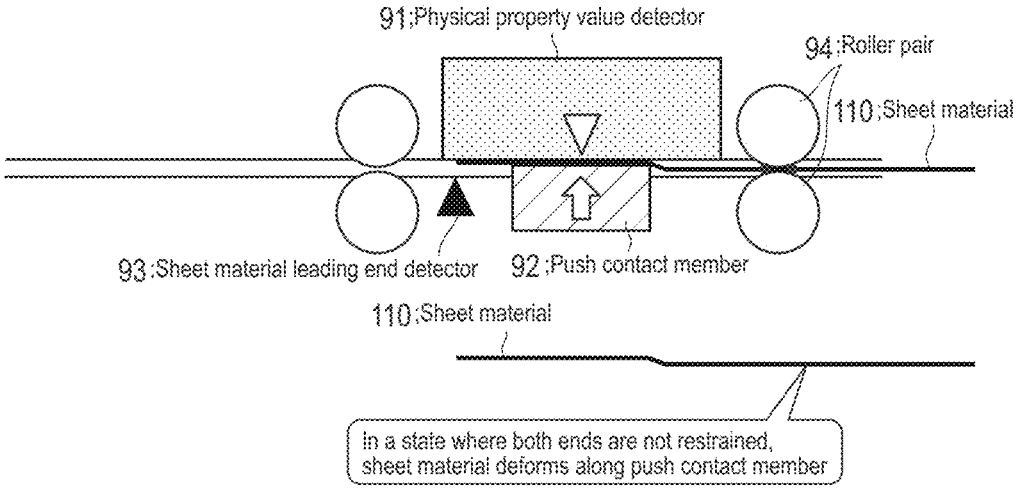
FIG. 6 is a schematic illustration showing operation of a measuring device according to one example of the present invention and showing a case where both ends of a sheet are not restrained.

At that time, as shown in FIG. 5, in a state where both ends of the sheet material 110 are held (restrained) by the roller pairs 94 (i.e., the two roller pairs 94), if the push contact member 92 pushes the sheet material 110, the sheet material 110 is pushed up in a state where the sheet material 110 has been stretched in the conveyance direction. Accordingly, damage such as tearing of the sheet material 110 will occur. Then, in the present example, as shown in FIG. 6, in a state where one of the upstream side or downstream side of the sheet material 110 relative to the physical property value detector 91 is not held, i.e., in a state where both ends are not restrained, the push contact member 92 is made to push the sheet material 110 so that the sheet material 110 deforms along the push contact member 92. Accordingly, the occurrence of the damage will be suppressed.

Figure 7A:
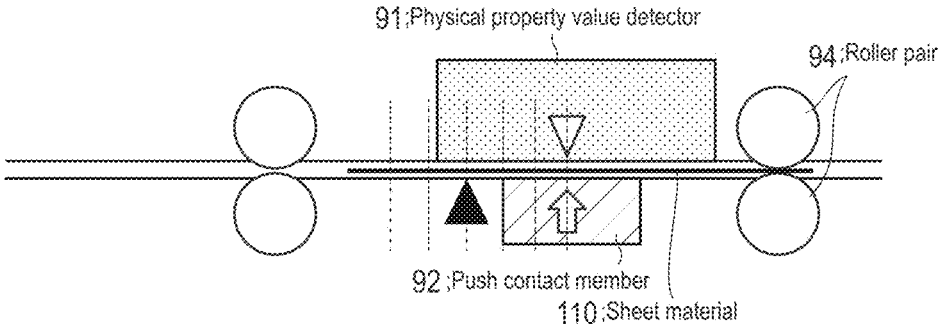
FIG. 7A is a schematic illustration showing operation of a measuring device according to one example of the present invention and showing a configuration in which one end of a sheet is released.

In this way, in order to realize the state where the both ends of the sheet material 110 are not held by the roller pairs 94, for example, as shown in FIG. 7A, the positional relationship of each part is adjusted such that, during repeating the detection by a predetermined number of times (for example, 5 times) at a predetermined interval (for example, 10 mm), the leading end of the sheet material 110 does not reach the roller pair 94 on the downstream side, or the back end of the sheet material 110 separates from the roller pair 94 on the upstream side. For example, by changing the arrangement of the sheet material leading end detector 93, the detection position of the leading end of the sheet material 110 is adjusted, or the detection interval (interval of the broken lines in FIGS. 7A and 7B) of a physical property value is adjusted. Moreover, in the case where the roller pair 94 on the upstream side or the roller pair 94 on the downstream side relative to the physical property value detector 91 on a conveyance route is configured to be movable in the extended direction of the conveyance route, by moving at least one of the roller pairs 94, it is possible to also adjust an interval between these roller pairs 94.

Figure 7B:
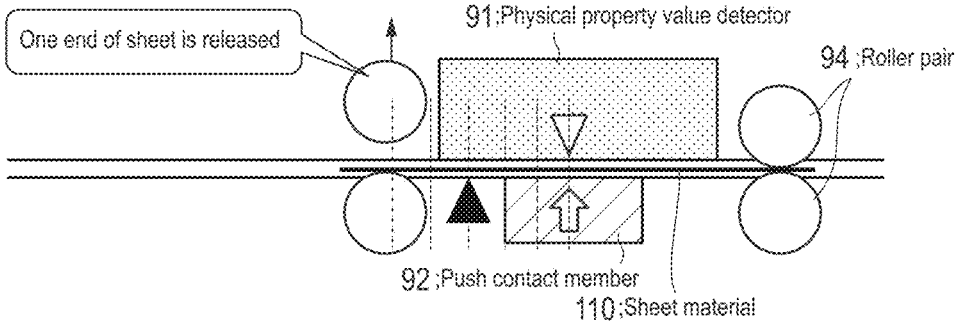
FIG. 7B is a schematic illustration showing an operation of a measuring device according to one example of the present invention and showing a configuration in which one end of a sheet is released.
Figure 8:
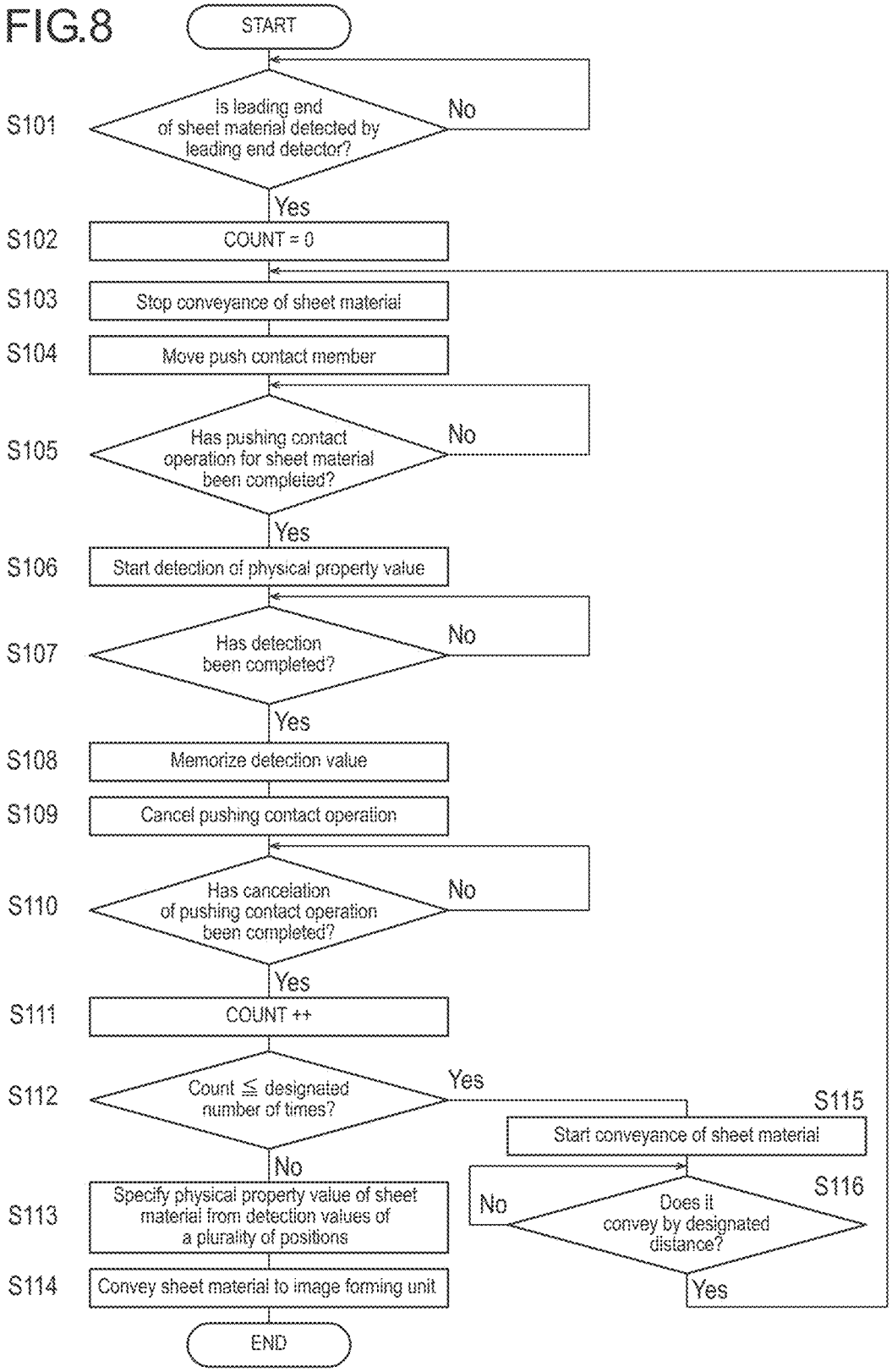
FIG. 8 is a flowchart showing operation of the measuring device according to one example of the present invention.

Moreover, as shown in FIG. 7B, in the case where one of the roller pair 94 on the upstream side or the roller pair 94 on the downstream side relative to the physical property value detector 91 on a conveyance route is configured to be able to adjust an interval between its rollers, when detecting a physical property value, an interval between the rollers of one roller pair 94 may be increased, and a state where the sheet material 110 is held, may be made by only the other roller pair 94.

Next, a measuring method using the above-described measuring device 90 is described. The CPU 11 develops the measurement control program memorized in the ROM 12 or the memory 20 into the RAM 13 and executes the program, thereby executing the processing of each step shown in the flowchart in FIG. 8.

First, the sheet material leading end detector 93 monitors the sheet material 110 conveyed from the sheet feeder 70 (S101), and when the sheet material leading end detector 93 has detected the leading end of the sheet material 110 (Yes in S101), the processor 10 (physical property value specifier 16) sets a counter to 0 (S102).

Next, the processor 10 (the first processor 14) controls the operations of the roller pairs 94 so as to stop the conveyance of the sheet material 110 (S103) and makes the push contact member 92 move in the direction toward the physical property value detector 91 (S104). Successively, the processor 10 (the first processor 14) determines whether the pushing to bring the sheet material 110 in contact with the physical property value detector 91 has been completed (S105). When the pushing contact operation has been completed (Yes in S105), the processor 10 makes the physical property value detector 91 operate and starts the detection of the physical property value of the sheet material 110 (S106).

Then, when the detection of the physical property value has been completed (Yes in S107), the processor 10 memorizes the detection value in the memory 20 etc. (S108). Successively, the processor 10 (the second processor 15) cancels the pushing contact operation by the push contact member 92 and makes the push contact member 92 move in the direction opposite to the physical property value detector 91 (S109). Then, when the cancellation of the pushing contact operation has been completed (the sheet material 110 has been separated from the physical property value detector 91) (Yes in S110), the processor 10 (physical property value specifier 16) adds a counter value (S111), and determines whether the counter value is the designated number of times decided beforehand or less (S112).

In the case where the counter value is the designated number of times or less (Yes in S112), the processor 10 (the second processor 15) starts the conveyance of the sheet material 110 (S115). When the sheet material 110 has been conveyed by only a designated distance (Yes in S116), the processing is made to return to S103, and the processor 10 (the first processor 14) stops the conveyance of the sheet material. On the other hand, in the case where the counter value exceeds the designated number of times (No in S112), the processor 10 (physical property value specifier 16) specifies the physical property value of the sheet material 110 from the detection values of a plurality of times (S113) and conveys the sheet material 110 to the image forming unit 80 (S114). Successively, the processor 10 notifies the specified physical property value to the image forming unit 80 and makes the image forming unit 80 execute image formation on the basis of the image formation condition according to the physical property value of the sheet material 110.

As described above, in the first processing, at the time of detecting the physical property value of the sheet material 110, the conveyance of the sheet material 110 is stopped, and the push contact member 92 is moved to push so as to bring the sheet material 110 in contact with the physical property value detector 91. Successively, in the second processing, after having detected the physical property value of the sheet material 110, the pushing contact operation by the push contact member 92 is canceled, the sheet material 110 is separated from the physical property value detector 91, and the conveyance of the sheet material 110 is started. Moreover, the first processing and the second processing are executed repeatedly, whereby it is possible to suppress damage to a sheet material and occurrence of conveyance jam.

In this connection, the present invention should not be limited to the above-described examples, and unless it deviates from the meaning of the present invention, the configuration and control can be changed suitably. For example, in the above-described example, description is given to the case where the measuring device 90 is incorporated into the image forming apparatus 1. However, also in the case where the measuring device 90 is made to operate alone, the measuring method of the present invention can be applied similarly.

Although embodiments of the present invention have been described and illustrated in detail, the disclosed embodiments are made for purpose of illustration and example only and not limitation. The scope of the present invention should be interpreted by terms of the appended claims.

INDUSTRIAL APPLICABILITY

The present invention is available for a measuring device that detects the physical property value of a sheet material, an image forming apparatus equipped with the measuring device, and a measuring method that detects the physical property value of a sheet material.

What is claimed is:

1. A measuring device, comprising:

on a conveyance route to convey a sheet material by a plurality of roller pairs, a physical property value detector assembly that detects a physical property value of the sheet material; and a push contact member that is configured to be movable in a direction orthogonal to a surface of the sheet material and performs a pushing contact operation to push the sheet material so as to bring the sheet material in contact with the physical property value detector assembly; further comprising:

a first processor to control first processing that stops conveyance of the sheet material, pushes the sheet material so as to bring the sheet material in contact with the physical property value detector assembly by using the push contact member, and detects a physical property value of the sheet material;

a second processor to control second processing that, after having detected the physical property value of the sheet material, cancels the pushing contact operation by the push contact member, separates the sheet material from the physical property value detector assembly, and starts conveyance of the sheet material; and a physical property value specifier that specifies the physical property value of the sheet material on a basis of physical property values of a plurality of positions within a surface of the sheet material detected by executing the first processing and the second processing repeatedly;

wherein the plurality of roller pairs includes a first roller pair on an upstream side and a second roller pair on a downstream side on the conveyance route relative to the physical property value detector assembly, the first processor detects a physical property value of the sheet material in a state where the sheet material is held by one of the first roller pair or the second roller pair;

one of the first roller pair or the second roller pair is configured such that an interval between rollers is adjustable, and the first processor detects the physical property value of the sheet material in a state where an interval between rollers of the one roller pair is increased and the sheet material is held by the other roller pair.

2. The measuring device according to claim 1, wherein the physical property value detector assembly includes:

a physical property value detector; and an opposing plate opposite to the push contact member via the sheet material and between the physical property value detector and the sheet material, and the first processor detects a physical property value of the sheet material in a state where the sheet material is sandwiched between the push contact member and the opposing plate, and the opposing plate is pushed so as to be brought in contact with the physical property value detector.

3. An image forming apparatus that forms an image on the sheet material, comprising:

the measuring device according to claim 1;

wherein an image forming condition of the sheet material is set on a basis of a physical property value of the sheet material specified by the measuring device.

4. The image forming apparatus according to claim 3, wherein the measuring device is disposed on the conveyance route between a sheet feeder and a registration unit of the image forming apparatus.

5. A measuring device, comprising:

on a conveyance route to convey a sheet material by a plurality of roller pairs, a physical property value detector that detects a physical property value of the sheet material; and a push contact member that is configured to be movable in a direction orthogonal to a surface of the sheet material and performs a pushing contact operation to push the sheet material so as to bring the sheet material in contact with the physical property value detector; further comprising:

a first processor to control first processing that stops conveyance of the sheet material, pushes the sheet material so as to bring the sheet material in contact with the physical property value detector by using the push contact member, and detects a physical property value of the sheet material;

a second processor to control second processing that, after having detected the physical property value of the sheet material, cancels the pushing contact operation by the push contact member, separates the sheet material from the physical property value detector, and starts conveyance of the sheet material; and a physical property value specifier that specifies the physical property value of the sheet material on a basis of physical property values of a plurality of positions within a surface of the sheet material detected by executing the first processing and the second processing repeatedly;

a sheet material leading end detector to detect a leading end of the sheet material on the conveyance route, wherein, when the sheet material leading end detector has detected a leading end of the sheet material, the first processor performs first physical property value detection.

6. A measuring method in a measuring device that includes, on a conveyance route to convey a sheet material by a plurality of roller pairs, a physical property value detector assembly that detects a physical property value of the sheet material and a push contact member that is configured to be movable in a direction orthogonal to a surface of the sheet material and performs a pushing contact operation to push the sheet material so as to bring the sheet material in contact with the physical property value detector assembly; the measuring method, comprising:

executing first processing that stops conveyance of the sheet material, pushes the sheet material so as to bring the sheet material in contact with the physical property value detector assembly by using the push contact member, and detects a physical property value of the sheet material;

second processing that, after having detected the physical property value of the sheet material, cancels the pushing contact operation by the push contact member, separates the sheet material from the physical property value detector assembly, and starts conveyance of the sheet material; and physical property value specifying processing that specifies the physical property value of the sheet material on a basis of physical property values of a plurality of positions within a surface of the sheet material detected by executing the first processing and the second processing repeatedly;

wherein the plurality of roller pairs includes a first roller pair on an upstream side and a second roller pair on a downstream side on the conveyance route relative to the physical property value detector assembly, and in the first processing, a physical property value of the sheet material is detected in a state where the sheet material is held by one of the first roller pair or the second roller pair;

wherein one of the first roller pair or the second roller pair is configured such that an interval between rollers is adjustable, and in the first processing, the physical property value of the sheet material is detected in a state where an interval between rollers of the one roller pair is increased and the sheet material is held by the other roller pair.

7. The measuring method according to claim 6, wherein the physical property value detector assembly includes:

a physical property value detector; and an opposing plate opposite to the push contact member via the sheet material and between the physical property value detector and the sheet material, in the first processing, a physical property value of the sheet material is detected in the state where the sheet material is sandwiched between the push contact member and the opposing plate, and the opposing plate is pushed so as to be brought in contact with the physical property value detector.

8. A measuring method in a measuring device that includes, on a conveyance route to convey a sheet material by a plurality of roller pairs, a physical property value detector that detects a physical property value of the sheet material and a push contact member that is configured to be movable in a direction orthogonal to a surface of the sheet material and performs a pushing contact operation to push the sheet material so as to bring the sheet material in contact with the physical property value detector; the measuring method, comprising:

executing:

first processing that stops conveyance of the sheet material, pushes the sheet material so as to bring the sheet material in contact with the physical property value detector by using the push contact member, and detects a physical property value of the sheet material;

second processing that, after having detected the physical property value of the sheet material, cancels the pushing contact operation by the push contact member, separates the sheet material from the physical property value detector, and starts conveyance of the sheet material; and physical property value specifying processing that specifies the physical property value of the sheet material on a basis of physical property values of a plurality of positions within a surface of the sheet material detected by executing the first processing and the second processing repeatedly;

wherein the image forming apparatus includes a sheet material leading end detector to detect a leading end of the sheet material on the conveyance route, wherein, when the sheet material leading end detector has detected a leading end of the sheet material, the first processor performs first physical property value detection.

* * * * *